United States Patent [19]

Clingman

[11] 4,057,106

[45] Nov. 8, 1977

BEST AVAILABLE COPY

[54] HOT WATER FLOOD

[76] Inventor: Walter L. Clingman, 2013 Andover Court, Oklahoma City, Okla. 73120

[21] Appl. No.: 704,425

[22] Filed: July 12, 1976

[51] Int. Cl.[2] ..... E21B 43/24

[52] U.S. Cl. ..... 166/57; 166/303

[58] Field of Search ..... 166/272, 303, 57

[56] References Cited

U.S. PATENT DOCUMENTS

| | | | |
|---|---|---|---|
| 3,237,692 | 3/1966 | Wallace et al. | 166/303 |
| 3,421,583 | 1/1969 | Koons | 166/303 |
| 3,980,137 | 9/1976 | Gray | 166/303 |

*Primary Examiner*—James A. Leppink

*Attorney, Agent, or Firm*—Dunlap, Codding & McCarthy

[57] ABSTRACT

An apparatus for injecting hot water into an oil well head to facilitate recovery of residual oil deposits.

1 Claim, 1 Drawing Figure

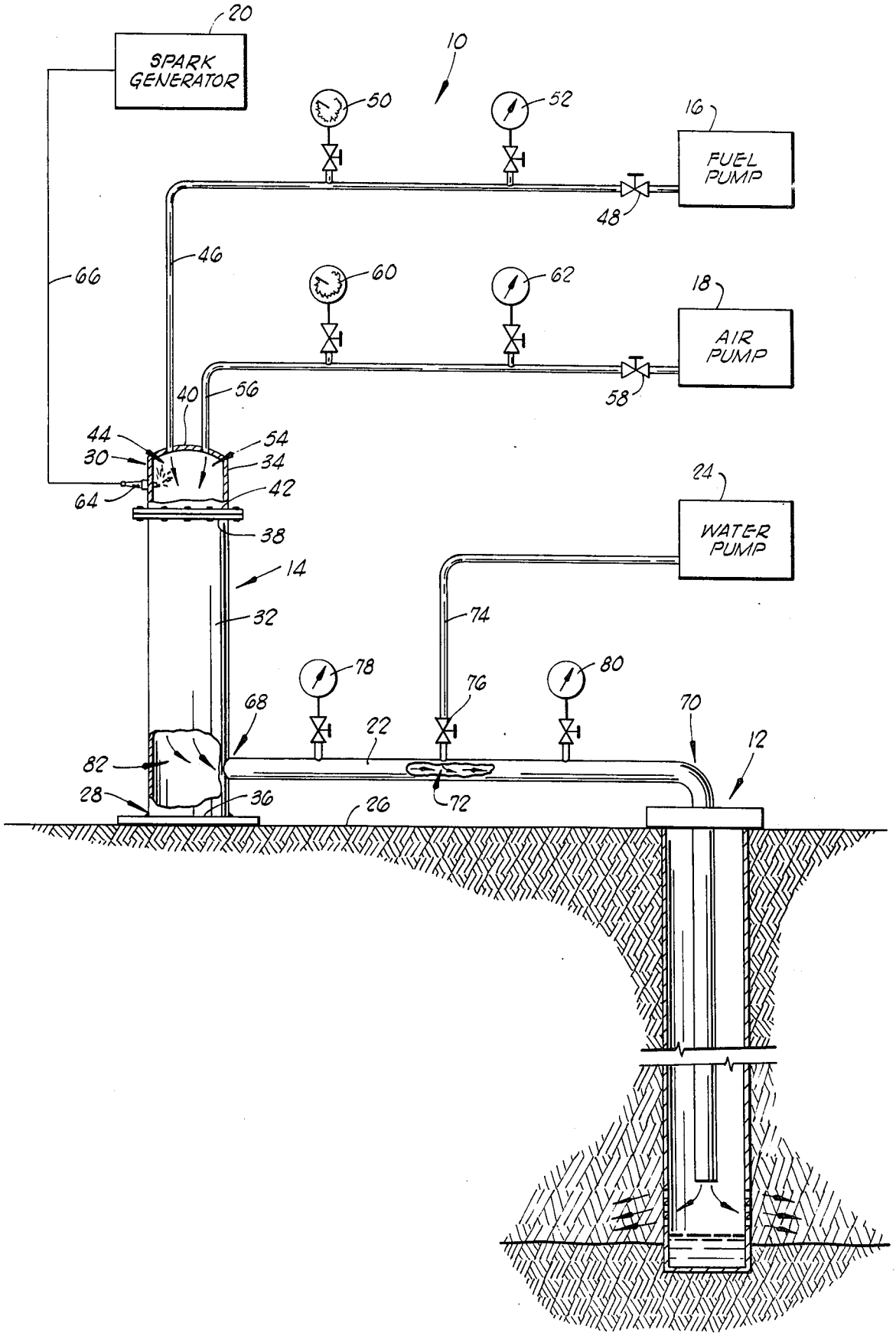
20
SPARK GENERATOR
10
50
52
16
FUEL PUMP
48
46
66
60
62
18
AIR PUMP
58
40
56
44
54
30
34
64
42
24
WATER PUMP
38
14
32
74
78
76
80
68
70
22
12
82
28
36
26
72

HOT WATER FLOOD

BACKGROUND OF THE INVENTION

1. Field of the Invention

This invention relates generally to tertiary petroleum oil recovery and, more particularly, but not by way of limitation, to an improved method and apparatus for injecting hot water into a partially depleted well for recovery of residual petroleum oil deposits.

2. Description of the Prior Art

Subsurface petroleum oil deposits are generally recovered via one of three methods. The primary method is commonly known as a "gusher" and is a spontaneously occurring phenomenon which sometimes results from a surface well being sunk into petroleum oil deposits containing a relatively large quantity of natural gases. The above method is generally rare, and short-lived, and is therefore not practical for commercial oil production. The secondary method of petroleum oil recovery is effected by creating an artificial pressure difference between the petroleum oil deposits and the atmosphere. This is generally accomplished via connecting a pump to a well head whereby the oil rises to the surface when the pump is in operation. The above method is regarded as practical and efficient but can be used to remove only a portion of the oil deposit contained in the subsurface formation. Tertiary methods must therefore be utilized to recover the remaining, or residual, portion of the oil deposit. Various methods have been proposed and utilized in the past and generally consist of injecting heated hydrocarbon gases, steam, water or various combinations thereof into the subsurface oil deposits. One particular method consits of injecting hot exhaust gases into a partially depleted well whereby the gases vaporize portions of the oil deposits and are pumped back to the surface for processing. Examples of this method are shown in the U.S. Pat. No. 1,342,741, issued to D. T. Day and U.S. Pat. No. 1,768,984, issued to L. J. Husted. Another method consists of injecting hot exhaust gases, in conjunction with steam and/or viscosity-lessening fluids, into a partially depleted well whereby the oil deposits are forced to adjacent recovery wells as shown in the U.S. Pat. Nos. 2,173,556, issued to H. W. Hixon and U.S. Pat. No. 2,813,583, issued to J. W. Marx, et al. A more recent method consists of injecting heated water into a partially depleted well whereby the oil viscosity is lessened and portions of the oil deposit are forced to adjacent recovery wells. Examples of this method are shown in the U.S. Pat. Nos. 3,186,484, issued to R. R. Waterman and U.S. Pat. No. 3,421,583, issued to D. S. Koons.

Generally related examples of the above recovery methods are shown in the following U.S. patents and references: U.S. Pat. No. 2,584,606, issued to E. S. Merriam, et al; U.S. Pat. Nos. 2,734,578 and 2,823,752, issued to H. Walter; U.S. Pat. No. 3,012,607, issued to C. L. De Priester, et al; U.S. Pat. No. 3,136,359, issued to T. T. Graham; U.S. Pat. No. 3,342,259, issued to H. H. Powell; U.S Pat. No. 3,360,044, issued to H. Lange; U.S. Pat. No. 3,386,508, issued to W. J. Bielstein, et al; and "Application of Heat for Recovery of Oil: Field Test Results and Possibility of Profitable Operation" by H. Walter published in the February, 1957 issue of the *Journal of Petroleum Technology*

SUMMARY OF THE INVENTION

It is an object of this invention to provide an improved method and apparatus for injecting heated water into an oil well head.

Another object of the invention is to provide the above method and apparatus for injecting heated water into a partially depleted oil deposit to effect recovery of residual oil contained therein.

A further object of the invention is to provide a hot water injection apparatus which can be easily and economically constructed.

One more object of the invention is to provide a hot water injection apparatus which is dependable, efficient and safe.

Other objects and advantages of the invention will be evident from the following detailed description when read in conjunction with the accompanying drawing which illustrates the preferred embodiment of the invention.

BRIEF DESCRIPTION OF THE DRAWING

The drawing illustrates a partial sectional, partial diagrammatic elevational view of a hot water injection apparatus constructed in accordance with the preferred embodiment of the present invention.

DESCRIPTION OF THE PREFERRED EMBODIMENT

Referring to the drawing, shown therein and referred to by the general reference number 10 is a hot water injection apparatus constructed in accordance with the preferred embodiment of the present invention. The injection apparatus 10 is constructed to inject hot water into an oil well head 12 for infusion into a subsurface formation. The injection apparatus 10 consists primarily of a combustion chamber 14, a fuel pump 16, an air pump 18, a spark generator 20, an injection conduit 22 and a water pump 24.

The combustion chamber 14 is substantially cylindrical in form, stands on a ground surface 26, and has a lower end 28 and an upper end 30. In one preferred form, as shown in the figure, the combustion chamber 14 is generally vertically disposed in relation to the ground surface 26. However, the combustion chamber 14 may also stand on the ground surface 26 in a generally horizontal disposition to provide substantially equal results in a similar fashion. In the preferred embodiment, the combustion chamber 14 is generally comprised of a cylindrical chamber 32 and a hemispherical chamber 34. More particularly, the cylindrical chamber 32 has a closed lower end 36 and a flanged upper end 38, while the hemispherical chamber 34 has a rounded upper end 40 and a flanged lower end 42, the cylindrical chamber 32 and the hemispherical chamber 34 being connected via the flanged ends 38 and 42, respectively, to form the combustion chamber 14. The combustion chamber 14 is preferrably formed from conventional oil field conduit components having a preferred diameter of 9 inches and a total height of 8 feet. If desired, a seal (not shown) may be disposed between the flanged ends 38 and 42 to further seal the combustion chamber 14.

The fuel pump 16 is connected to the upper end 30 of the combustion chamber 14 and injects combustible fuel 44 into the combustion chamber 14 at a predetermined fuel injection rate. More particularly, the fuel pump 16 is connected to, and communicates with, the hemispherical chamber 34 via a fuel conduit 46 connected to the upper end 40 thereof. The fuel injection rate is generally controlled by a fuel control valve 48 interposed in the fuel conduit 46 generally between the fuel pump 16 and the combustion chamber 14. In the preferred embodiment, a fuel volume meter 50 of the recording type and a fuel pressure gauge 52 are connected to the fuel conduit 46 generally between the fuel control valve 48 and the combustion chamber 14 to provide visual indications of the flow rate and pressure of the fuel within the fuel conduit 46. Thus, the fuel injection rate may be easily determined and maintained to assure safe and proper operation of the injection apparatus 10. The fuel pump 16, fuel conduit 46, fuel control valve 48, fuel volume meter 50 and fuel pressure gauge 52 are conventional types well known in the art. Natural gas, which is generally available at the well site, is preferably utilized as the combustible fuel 44. However, most any combustible fuel may be utilized such as butane, propane, diesel or crude oil.

The air pump 18 is also connected to the upper end 30 of the combustion chamber 14 and injects air 54 into the combustion chamber 14 at a predetermined air injection rate. More particularly, the air pump 18 is connected to, and communicates with, the hemispherical chamber 34 via an air conduit 56 connected to the upper end 40 thereof. The air injection rate is generally controlled by an air control valve 58 interposed in the air conduit 56 generally between the air pump 18 and the combustion chamber 14. In the preferred embodiment, an air volume meter 60 of the recording type and an air pressure gauge 62 are connected to the air conduit 56 generally between the air control valve 58 and the combustion chamber 14 to provide visual indications of the flow rate and pressure of the air within the air conduit 56. Thus, the air injection rate can be determined and maintained to assure safe operation of the injection apparatus 10. The air pump 18, air conduit 56, air control valve 58, air volume meter 60, and air pressure gauge 62 are conventional types well known in the art.

The spark generator 20 is connected to a spark ignitor 64 via a signal path 66. The spark ignitor 64, which is preferrably a conventional spark plug or the like, is removably disposed through the upper end 40 of the hemispherical chamber 34 in a conventional manner. The spark generator 20 cooperates in a conventional manner with the spark ignitor 64 to provide an ignition spark within the combustion chamber 14 for initiating combustion of the combustible fuel 44 injected by the fuel pump 16 into the combustion chamber 14. Once the combustible fuel 44 is ignited, burning thereof is substantially continuous as long as adequate quantities of fuel and air are pumped into the combustion chamber 14. Therefore, it is only necessary for the spark ignitor 64, via the spark generator 20, to produce one spark for each period of use of the hot water injection apparatus 10.

The injection conduit 22 is connected between the lower end 28 of the combustion chamber 14 and the well head 12. More particularly, one end 68 of the injection conduit 22 is connected to the cylindrical chamber 32 near the lower end 36 thereof, while the other end 70 of the injection conduit 22 is connected to the well head 12, the injection conduit 22 providing communication between the combustion chamber 14 and the well head 12. In the preferred embodiment, the injection conduit 22 is formed from conventional oil field conduit components having a preferred diameter of 1 to 2 inches.

The water pump 24 is connected to the injection conduit 22 generally between the combustion chamber 14 and the well head 12 and injects water 72 into the injection conduit 22 at a predetermined water injection rate. More particularly, the water pump 24 is connected to, and communicates with, the conduit 22 via a water conduit 74 connected to the injection conduit 22 in a conventional manner. The water injection rate is generally controlled by a water control valve 76 interposed in the water conduit 74 between the water pump 24 and the injection conduit 22. In the preferred embodiment, a first heat gauge 78 is connected to the injection conduit 22 generally between the combustion chamber 14 and the junction between the water conduit 74 and the injection conduit 22, and a second heat gauge 80 is connected to the injection conduit 22 generally between the well head 12 and the junction between the water conduit 74 and the injection conduit 22. As will be clear to those skilled in the art, the first and second heat gauge 78 and 80 cooperate to provide visual indications of the temperature of the materials within the injection conduit 22 before and after injection of the water 72 and facilitate determination and maintenance of the water injection rate to assure safe operation of the injection apparatus 10. The water pump 24, water control valve 76, and the first and second heat gauge 78 and 80, respectively, are conventional types well known in the art.

OPERATION OF THE PREFERRED EMBODIMENT

In operation, the injection apparatus 10 is preferrably assembled near the well head 12 to facilitate connection of the injection conduit 22 between the combustion chamber 14 and the well head 12. It will be assumed hereinafter that the fuel pump 16 is connected to a suitable source of fuel, the air pump 18 is connected to a suitable source of air, and the water pump 24 is connected to a suitable source of water.

Upon actuation, the fuel pump 16 will inject the combustible fuel 44 into the upper end 30 of the combustion chamber 14 at a predetermined fuel injection rate determined primarily be the fuel control valve 48. For ease of determining the fuel injection rate, the fuel volume meter 50 measures and records the rate of flow of the fuel 44 through the fuel conduit 46 over a predetermined time period, while the fuel pressure gauge 52 provides a visual indication of the fluid pressure within the fuel conduit 46 in a continuous manner. Although the fuel injection rate will be highly dependent upon the condition of the subsurface formation, satisfactory operation of an injection apparatus 10 constructed in accordance with the dimensions given hereinbefore has been obtained with a fuel injection rate on the order of 2,500 cubic feet per hour at a fuel pressure on the order of 350 to 450 psi.

Upon actuation substantially simultaneously with the actuation of the fuel pump 16, the air pump 18 will inject air 54 into the upper end 30 of the combustion chamber 14 at a predetermined air injection rate determined primarily by the air control valve 58. For ease of determining the air injection rate, the air volume meter 60 measures and records the rate of flow of the air 54 through the air conduit 56 over a predetermined time period, while the air pressure gauge 62 provides a visual indication of the air pressure within the air conduit 56 in a continuous manner. Although the air injection rate will be highly dependent upon the condition of the subsurface formation, satisfactory operation of an air injection apparatus 10 constructed in accordance with the dimensions given hereinbefore has been obtained with an air injection rate on the order of 25,000 cubic feet per hour at an air pressure on the order of 350 to 450 psi.

Upon actuation thereof, the spark generator 20 will provide an ignition spark within the combustion chamber 14 via the spark ignitor 64 for initiating combustion of the mixture of combustible fuel 44 and air 54 injected into the combustion chamber 14 via the fuel pump 16 and air pump 18, respectively. Subsequently, combustion of the combustible fuel mixture is substantially continuous via the initial burning thereof.

As will be clear to those skilled in the art, the spark generator 20 cooperates with the fuel pump 16 and with the air pump 18 to produce relatively large quantities of heated combustion gases 82 for injection into the injection conduit 22. When the temperature of the combustion gases 82 has attained a desired temperature on the order of 900 to 1100 degrees Fahrenheit, the water pump 24 may be actuated to commence injection of the water 72 into the injection conduit 22 at a predetermined water injection rate. For ease of determinging the proper time for actuating the water pump 24 and for determining the water injection rate, the first and second heat gauges 78 and 80, respectively, cooperate to provide visual indications of the combustion gases 82 before injection of the water 72 so that the amount of heat absorbed by the injected water 72 may be determined. Although the water injection rate will be highly dependent upon the quantity and temperature of the combustion gases 82 and on the condition of the subsurface formation, satisfactory operation of an injection apparatus 10 consturcted in accordance with the dimensions given hereinbefore has been obtained with a water injection rate on the order of 8 barrels per minute.

Changes may be made in the construction and the arrangement of the parts or the elements of the preferred embodiment as described herein without departing from the spirit and scope of the invention as defined in the following claims.

What is claimed is:

1. Injection apparatus for injecting hot water into an oil well head, the injection apparatus comprising:

a substantially cylindrical combustion chamber having an upper end and a lower end;

a fuel pump connected to the upper end of the combustion chamber, the fuel pump injecting combustible fuel into the combustion chamber at a predetermined fuel injection rate;

an air pump connected to the upper end of the combustion chamber, the air pump injecting air into the combustion chamber at a predetermined air injection rate;

a spark generator connected to the combustion chamber near the upper end thereof, the spark generator providing sparks for initiating combustion of the combustible fuel injected by the fuel pump into the combustion chamber;

an injection conduit connected between the lower end of the combustion chamber and the well head, the injection conduit providing communication between the combustion chamber and the well head, whereby the combustion gases are injected through the injection conduit into the well head; and a water pump connected to the injection conduit between the combustion chamber and the well head, the water pump injecting water into the injection conduit at a predetermined water injection rate, whereby the injected water is heated by the combustion gases and injected therewith into the well head via the injection conduit.

* * * * *